US006581666B1

(12) United States Patent
Bartholin et al.

(10) Patent No.: US 6,581,666 B1
(45) Date of Patent: Jun. 24, 2003

(54) OPERATING DEVICE FOR WINDOW OPENERS, SCREENING ARRANGEMENTS AND SIMILAR DEVICES

(75) Inventors: Niels Bartholin, Lyngby (DK); Susumu Kitazawa, Tokyo (JP)

(73) Assignee: VKR Holding A/S, Søborg (DK)

( * ) Notice: Subject to any disclaimer, the term of this patent is extended or adjusted under 35 U.S.C. 154(b) by 0 days.

(21) Appl. No.: 09/914,851

(22) PCT Filed: Mar. 3, 2000

(86) PCT No.: PCT/DK00/00095

§ 371 (c)(1),
(2), (4) Date: Oct. 26, 2001

(87) PCT Pub. No.: WO00/53881

PCT Pub. Date: Sep. 14, 2000

(30) Foreign Application Priority Data

Mar. 5, 1999 (DK) ..... 1999 00311

(51) Int. Cl.[7] ..... E06B 9/38

(52) U.S. Cl. ..... 160/177 R; 160/178.1 R; 74/545; 403/353; 464/148

(58) Field of Search ..... 160/177 R, 178.1 R, 160/174 R, 176.1 R, 177 V; 16/422, 426, 427; 464/106, 148; 403/353; 74/543, 545, 548; 81/177.85; 49/87.1

(56) References Cited

U.S. PATENT DOCUMENTS

| | | | | | |
|---|---|---|---|---|---|
| 2,143,348 | A | * | 1/1939 | Gibson | |
| 2,722,420 | A | * | 11/1955 | Adamson | 273/407 |
| 4,141,402 | A | * | 2/1979 | Marotto | |
| 4,257,470 | A | * | 3/1981 | Woodle | |
| 4,507,831 | A | | 4/1985 | McClure | |
| 4,676,292 | A | * | 6/1987 | Valle et al. | |
| 4,733,683 | A | * | 3/1988 | Pozzi | 160/22 |
| 4,875,516 | A | * | 10/1989 | Marocco | |
| 5,002,113 | A | * | 3/1991 | Georgopoulos | |
| 5,060,995 | A | * | 10/1991 | Goldstein et al. | 294/19.1 |
| 5,092,387 | A | * | 3/1992 | King et al. | |
| 5,743,152 | A | | 4/1998 | Grudl | |
| 5,749,406 | A | * | 5/1998 | Benthin | |
| 5,782,281 | A | * | 7/1998 | Moller | 160/92 |
| 6,044,890 | A | * | 4/2000 | Renee | |
| 6,325,133 | B1 | * | 12/2001 | Lin | |

FOREIGN PATENT DOCUMENTS

| | | | |
|---|---|---|---|
| DE | 3201707 | A1 | 7/1983 |
| DE | 3623612 | A1 | 1/1988 |
| DE | 3625604 | A1 | 2/1988 |
| EP | 0 246 338 | | 11/1987 |
| EP | 0570811 | A1 | 5/1993 |
| FR | 1 526 095 | | 4/1968 |
| GB | 1018692 | * | 2/1966 |
| WO | WO 8002714 | * | 12/1980 |

* cited by examiner

*Primary Examiner*—Blair M. Johnson
(74) *Attorney, Agent, or Firm*—Venable; John P. Shannon; Chad C. Anderson

(57) ABSTRACT

An operating device for window openers, screening arrangement and similar devices comprising an operating rod (6) with a hook-shaped operating elements (5) in its end and a rotatable coupling element (3) connected to said window opener or screening arrangement and having the form of an essentially annular eye with an aperture (8) with an area which is considerably larger than the cross-section of the hook-shaped operating element (5) such that at the insertion of the hook-shaped operating element in said aperture, the coupling element can be turned by means of the operating rod while simultaneously pulling the coupling element, where the annular eye in connection with said aperture (8) comprises a narrowed additional aperture (10) which, at least upon reception of the hook-shaped operating element as a result of said pull, encircles the operating element relatively closely.

5 Claims, 1 Drawing Sheet

OPERATING DEVICE FOR WINDOW OPENERS, SCREENING ARRANGEMENTS AND SIMILAR DEVICES

The present invention relates to an operating device for window openers, screening arrangements and similar devices and of the kind stated in the introductory part of claim 1.

An operating device of the known type comprises a rod with an end hook intended for releasable engagement with an eye having an aperture, the area of which is essentially larger than the cross-section of the hook. With this operating device, it is relatively easy to bring the hook into engagement with the eye, but on the other hand, considerable attention is required to avoid that the hook disengages the eye, in particular if the rod axis forms an angle with the rotational axis of the eye.

DE 4 231 504 discloses an operating device comprising an operating rod with an end hook shaped as the FIG. 7, and a coupling element with an annular eye, the aperture of which has an area which is a little larger than the cross-section of the hook. This operating device assures a secure engagement between the hook and the coupling element, however, it is very difficult to bring the hook into engagement with the eye of the coupling element as the area of the aperture is only a little larger than the cross-section of the hook.

The object of the invention is an operating device which can be operated by operating rods provided with hooks of different shapes and which is simple to bring into engagement between the hook and the coupling element and at the same time assures a secure engagement even if the rod axis forms an angle with the rotational axis of the coupling element.

According to the invention, this is obtained in that the annular eye in connection with said aperture comprises a narrowed additional aperture which, at least upon reception of the hook-shaped operating element as a result of a pull, securely engages the operating element.

An operating device of this kind permits an easy insertion of the hook-shaped operating element into the essentially annular eye of the coupling element, as the eye has an aperture with an area essentially larger than the cross-section of the hook-shaped operating element. Subsequently, the hook-shaped operating element can be moved to the narrowed additional aperture whereby a secure engagement during operation is obtained even if the rod axis forms an angle with the rotational axis of the operating element.

The engagement can according to the invention be further improved by providing the coupling element in one or both of the annular profiles with at least three hinge portions. By this design, a squeezing effect can be obtained around the hook-shaped element in the additional aperture when at the same time, a pull of the hook-shaped element is effected in a direction away from the large aperture.

According to an alternative embodiment, the engagement can be improved by producing the entire or a part of the annular profile around the additional aperture from an elastic material.

Figure 1:
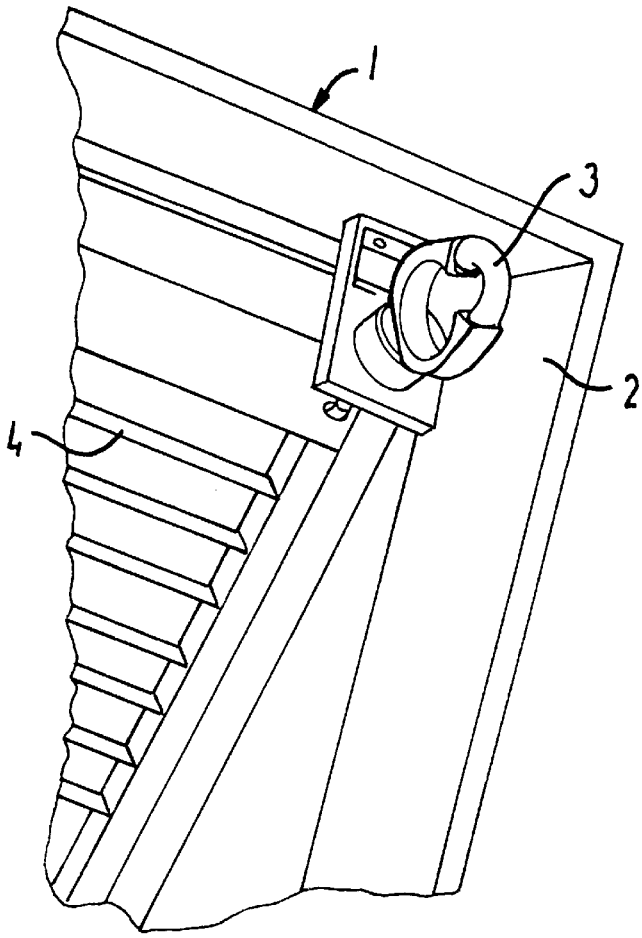
Figure 5:
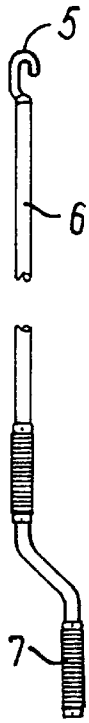
Figure 2:
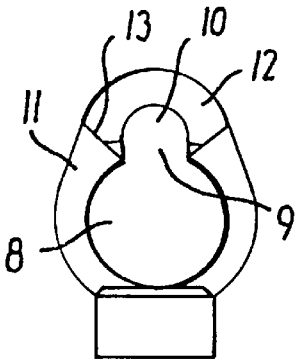
Figure 3:
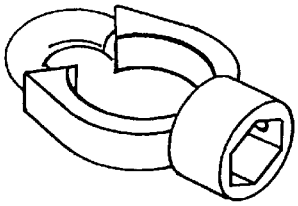
Figure 4:
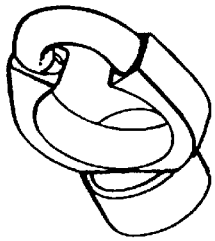
Figure 6:
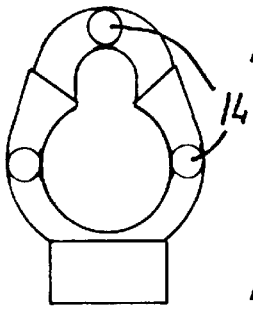

In the following, the invention is explained in more detail with reference to the drawing, where FIG. 1 is a section of the top inner corner of a window with a coupling element, FIG. 2 shows the coupling element seen in the direction of the opening, FIG. 3 is a perspective view of the coupling element seen obliquely from below, FIG. 4 is a perspective view of the coupling element seen obliquely from above, FIG. 5 is an operating rod with a hook meant for engagement with the coupling element, and FIG. 6 is a coupling element with hinge portions.

FIG. 1 shows the top right corner of a window 1 where a drive with a coupling element 3 for a Venetian blind 4 is mounted on the main frame 2.

The element 3 is meant for engagement with a hook 5 in one end of an operating rod 6 shown in FIG. 5.

In the other end, the operating rod 6 has a crank handle 7 or an electrical drive for turning the operating rod in clockwise or counterclockwise direction when the Venetian blind is to be operated.

As seen in FIG. 2, the coupling element 3 is shaped as an annular eye in which an essentially keyhole-shaped cut comprises a first essentially circular aperture 8 with an area which is considerably larger than the cross-section of the hook 5 in connection to a smaller, narrowed second aperture 10 with essentially the same area as the cross-section of the hook 5 via a narrowed opening 9.

By an appropriate choice of the size of the aperture 8, it is easy with the operating rod 6 to catch the eye 8 with the hook 5, whereupon the hook 5 by pulling the rod 6 in a direction away from the window is transferred to the smaller aperture 10 via the opening 9. The opening 9 can be adapted to the cross-section of the hook in such a way that the hook 5 is to be pulled through the opening at a certain predetermined force.

The coupling element may advantageously be designed with a mainly rectangular cross-section of the annular profile 11 delimiting the aperture 8 and a mainly circular cross-section of the annular profile 12 delimiting the aperture 10.

At the transition between the annular profiles 11 and 12, the coupling element may appropriately be provided with shoulder-shaped stop faces 13 for the hook 5 when the latter is in the aperture 10. Thus, a good continuous engagement is assured for the hook 5 both when the rod axis during operation stays flush with the rotational axis of the coupling element such that the hook 5 is opposite the opening 9, and when the rod axis forms an angle of e.g. 45° with the rotational axis of the coupling element, the hook thus entering into abutment with one of the faces 13.

In the shown embodiment of the Venetian blind operating device, the coupling element 3 can be connected with conventional drives for the pull and/or rise cords of the Venetian blind 4 through a flexible cable 14 (Bowden cable) via an engagement secured against rotation e.g. with a hexagon profile 15 as shown in FIG. 3.

As shown in FIG. 6, the coupling element an appropriately be provided with hinge portions 14, e.g. in the form of recesses in the annular profile, insertions of elastic material, or in that the annular profile is assembled by several joints in rotary connections, or in a similar way. A compression of the small annular profile 12 is obtained around the hook-shaped element 5 by a pull away from the circular aperture 8, whereby an even better engagement is assured.

Alternatively, the entire or a part of the annular profile 12 can be produced from an elastic material, whereby the small annular profile 12 can squeeze the hook-shaped element 5 by a pull away from the circular aperture 8, thus assuring a good engagement.

The operating device may also be used in connection with other forms of window screenings such as roller blinds or roller shutters, or for manual operation of window operators. The operating device may also be used for operation of devices other forms of devices, e.g. hatches for attic stairs and alike.

What is claimed is:

1. An operating system for closure devices, the devices including window openers and screening arrangements, said system comprising a separate operating rod having at one end a hook-shaped operating element for disengageable connection with a rotatable coupling element connected to said device, said coupling element having the form of an eyelet with a first aperture with a center and having an area which is considerably larger than the cross-section of the hook-shaped operating element such that at the insertion of the hook-shaped operating element in said first aperture, the coupling element can be turned by the operating rod while simultaneously pulling the operating rod, wherein said coupling element further comprises a narrowed additional aperture with a center and in communication with the first aperture, the centers of the first aperture and the additional aperture being mutually off-set, to receive and securely engage with the hook-shaped operating element.

2. An operating system according to claim 1, wherein the first aperture of the eyelet is essentially circular and limited by an annular profile with a mainly rectangular cross-section, whereas the additional aperture is limited by an annular profile with an essentially circular cross-section, said additional aperture having essentially the same area as the cross-section of the hook-shaped operating element.

3. An operating system according to claim 2, wherein the coupling element comprises shoulder-shaped stop faces at the transition between the annular profiles.

4. An operating system according to claim 1, wherein the eyelet of the coupling element comprises a narrowed opening between the first aperture and the additional aperture.

5. An operating system according to claim 2, wherein at least a part of the annular profile of the additional aperture is made of an elastic material.

* * * * *